US005156558A

United States Patent [19]

Belanger, Jr.

[11] Patent Number: 5,156,558

[45] Date of Patent: Oct. 20, 1992

[54] HORIZONTAL MATING CONNECTOR

[75] Inventor: Thomas D. Belanger, Jr., Saline, Mich.

[73] Assignee: Ford Motor Company, Dearborn, Mich.

[21] Appl. No.: 709,462

[22] Filed: Jun. 3, 1991

[51] Int. Cl.[5] ..... H01R 13/629

[52] U.S. Cl. ..... 439/376; 29/869

[58] Field of Search ..... 439/266, 310, 342, 376, 439/347, 680; 29/869

[56] References Cited

U.S. PATENT DOCUMENTS

| | | | |
|---|---|---|---|
| 3,020,511 | 2/1962 | Raver | 439/376 |
| 3,869,186 | 3/1975 | Teagno | 439/342 |
| 4,103,983 | 8/1978 | Morrison et al. | 339/91 |
| 4,418,975 | 12/1983 | O'Keefe II | 339/91 |
| 4,755,906 | 7/1988 | Belanger, Jr. | 361/413 |
| 4,755,907 | 7/1988 | Belanger, Jr. | 361/413 |
| 4,794,488 | 12/1988 | Belanger, Jr. | 361/395 |
| 4,797,784 | 1/1989 | Belanger, Jr. | 361/395 |
| 4,797,786 | 1/1989 | Belanger, Jr. | 361/419 |
| 4,821,149 | 4/1989 | Belanger, Jr. | 361/395 |
| 4,903,168 | 2/1990 | Belanger, Jr. | 361/413 |

*Primary Examiner*—Eugene F. Desmond

*Attorney, Agent, or Firm*—Peter Abolins; Mark Mollon

[57] ABSTRACT

An electrical connector includes terminals and receptacles mating at an angle relative to the horizontal force applied to couple them. Keying flanges mounted on a terminal housing slide along guide channels of a receptacle frame in a first direction, and are then directed along keying slots in a second direction, angularly related to the first direction, to mate the terminals and receptacles mounted in the receptacle frame. The connector is compact and may be assembled with application of a single coupling force in one direction. The angular disposition of terminals and receptacles provides improved resistance to uncoupling. A system of such electrical connectors is provided, including means for preventing cross-connection of unrelated circuits and components. Finally, a method for interconnecting electrical circuits and components with such electrical connectors is provided.

35 Claims, 5 Drawing Sheets 14
20
48a
22
48b
24
46
28
42
24
28
20
40
36
46
16
10
44b
12
18
44a
32
32

14
48a
48b
10
18
12
44a
32
32

HORIZONTAL MATING CONNECTOR

BACKGROUND OF THE INVENTION

The present invention relates generally to electrical connectors, and more particularly, to a connector having terminals and receptacles mating at an angle relative to the horizontal force applied to assemble the connector.

Plug-in connectors have become widely known and used in the electronics industry for interconnecting electrical circuits and circuit components. For example, Morrison et al, U.S. Pat. No. 4,103,983 slidably connects electronic equipment to a mounting with pin and socket connectors. O'Keefe, II, U.S. Pat. No. 4,418,975, slidably couples a plurality of spaced, offset rows of connector blocks to a corresponding plurality of terminal pads located on electronic equipment. Belanger, Jr., in U.S. Pat. Nos. 4,755,906, 4,755,907 and 4,903,168, interconnects electrical substrates to carrier substrates. Tabs on the electrical substrate are guided by sloped channels in the carrier substrate to bring horizontal pins and sockets on the respective substrates into alignment for interconnection. In each case, the mating connector elements of Morrison et al, O'Keefe II, and Belanger, Jr. are coupled along a line parallel to the coupling force.

Such plug-in connectors are needed so that a plurality of connections may be made quickly without tedious and time consuming hardwiring, so connectors may be readily connected and disconnected, and so that compact configurations are made possible where space is at a premium. New structures are therefore continually sought to satisfy these needs and provide improved means for interconnecting electrical circuits and components.

SUMMARY OF THE INVENTION

This need is met by the present invention in which an improved, compact connector includes mating first and second electrical terminal elements, such as terminal pins and terminal pin receptacles, disposed at an angle relative to the direction in which coupling forces are applied. The connector includes a terminal housing which may be slidably inserted into a receptacle frame upon the application of a coupling force in a single direction and with a single motion. The terminal housing has a plurality of keying flanges extending laterally therefrom which slide into corresponding guide channels in the receptacle frame. As the terminal housing is inserted into the receptacle frame, it encounters at least one first sloped wall positioned at an end of the guide channels. The first sloped wall directs the keying flanges of the terminal housing into a plurality of keying slots, displacing the housing at an angle relative to the guide channels, and aligning the mating terminal pins and terminal pin receptacles for coupling. In addition, trailing down ramps may be provided on the terminal housing to further maintain the parallel relation and alignment between the terminal housing and the receptacle frame as the terminal pins and terminal pin receptacles are intermated.

The angled position of the terminal pins and terminal pin receptacles permits a more compact design, and requires higher coupling and uncoupling forces than connectors which mate in a direction parallel to the applied coupling force. The compact design tends to be flatter and shorter which makes the connector of the present invention well suited for use in automotive applications, such as in dashboards, where space is limited. Further, a more secure connection results which resists accidental disconnection, without need for additional fasteners. Even though the keying flanges, guide channels and keying slots guide the terminal housing along an angled path to couple the terminal pins and terminal pin receptacles at an angle to the coupling force, coupling and uncoupling forces need to be applied only in a single direction.

Additional features may be provided in the connector of the present invention. Force applying means may be included to assist in coupling and uncoupling the terminal housing and receptacle frame. Further, the terminal pins and terminal pin receptacles may be assembled in groups on one or more removable housing blocks or frame blocks, to make the connector more versatile, facilitate production, facilitate attachment of wires or components to terminal pins or terminal pin receptacles, permit interchange of housing blocks or frame blocks, and the like. It is understood that the terminal pins and terminal pin receptacles may be included in either the terminal housing or in the receptacle frame, as may suit the application.

In a further aspect of the present invention, a system including two or more connectors is provided for connecting a plurality of electrical circuits in accordance with the present invention. The system includes means for preventing inadvertent cross-connection between unrelated connector terminal housings and receptacle frames as a safety feature where a plurality of connectors are required. Such means include producing the terminal housings with keying flanges having different dimensions, and providing the receptacle frames with guide channels having corresponding dimensions. Similarly, the angle at which at least one first sloped wall at the end of a guide channel and the angle at which the side walls of the keying slots are sloped may be varied, so that the corresponding angles on the keying flanges prevent their being directed down the keying slots of non-mating receptacle frames. Means for preventing cross-connection may further include varying the spacing between the keying slots and the end of the guide channels, or varying the spacing between the keying slots themselves. The corresponding locations of keying flanges on respective terminal housings would prevent the cross-connection of unrelated terminal housings and receptacle frames.

Finally, a method for interconnecting electrical circuits is provided in which a terminal housing having first angularly oriented electrical terminal elements is inserted into a receptacle frame having second angularly oriented electrical terminal elements, and guided within the receptacle frame to align and intermate the first and second electrical terminal elements along the angular orientation. In accordance with the method, the angular orientation is at an angle to the applied interconnecting force.

It is therefore a feature of the present invention to provide a connector for interconnecting electrical circuits wherein terminal pins and terminal pin receptacles are disposed and interconnected to one another in angular relation to the applied coupling force. It is another feature of the present invention to provide a compact, secure connector. A further feature of the present invention is that such a connector requires a force directed in a single direction for insertion and coupling of mating parts. Yet another feature of the present invention is to provide a system for interconnecting a plurality of electrical circuits with two or more connectors which have means for preventing cross-connection. Finally, a feature of the present invention is to provide a method for interconnecting electrical circuits. These and other features of the present invention will be apparent from a review of the detailed description taken with the drawing figures included herein.

DETAILED DESCRIPTION OF THE PREFERRED EMBODIMENT

Figures 1, 9:
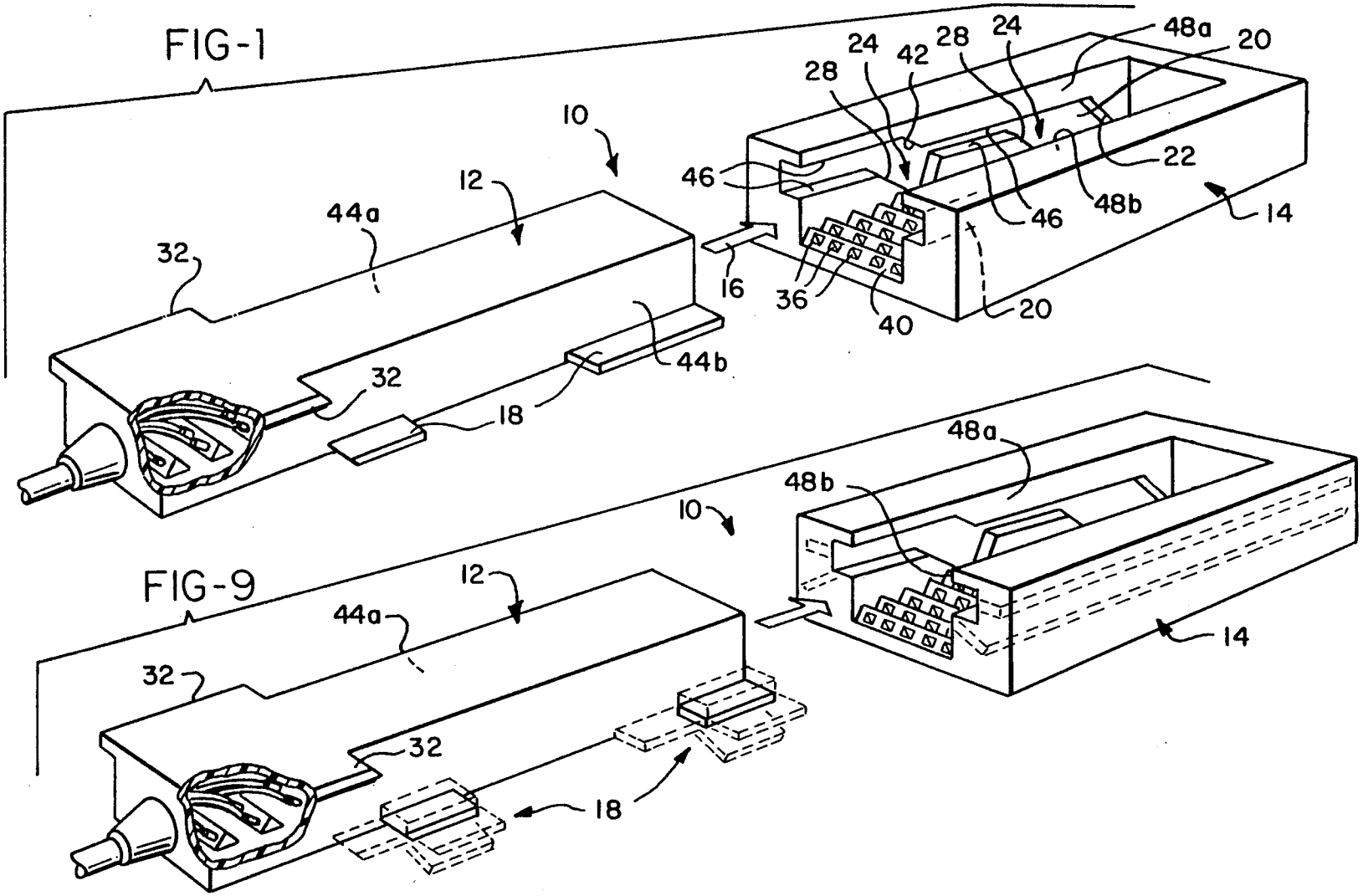
FIG. 1 is a schematic perspective view of the connector of the present invention prior to assembly.
FIG. 9 is a schematic perspective view of the connector of the present invention prior to assembly showing means for preventing cross-connection.

Referring to FIG. 1, in accordance with the present invention, a connector 10 is provided having a terminal housing 12 and receptacle frame 14. Terminal housing 12 is slidably insertable into receptacle frame 14 upon application of a coupling force in a single direction with a single motion, as indicated at 16.

Figure 5:
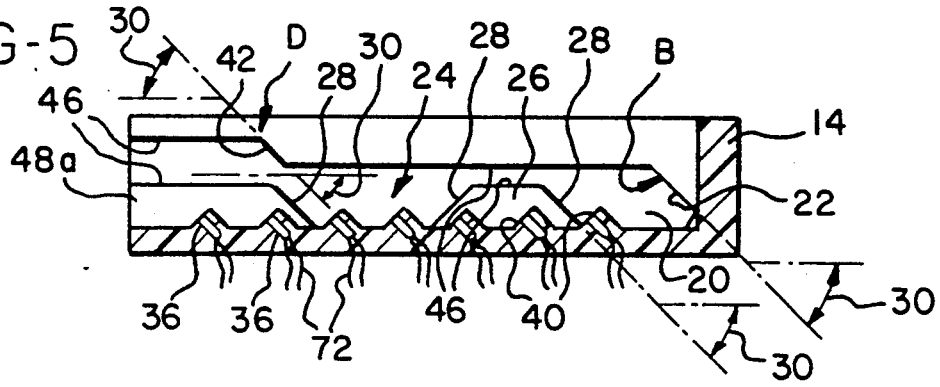
FIG. 5 is a cross-sectional view of the receptacle frame of the present invention taken along section line 5—5 of FIG. 4.

Guidance means for coupling terminal housing 12 and receptacle frame 14 include a plurality of keying flanges 18 extending from terminal housing 12 which slide into a plurality of guide channels 20 provided in receptacle frame 14. With reference to FIGS. 1 and 5, at least one first sloped wall 22, also referred to as a down ramp, is provided at the end of guide channels 20 to direct keying flanges 18 into a plurality of keying slots 24. Keying slots 24 define a guide key 26, and preferably include one or more side walls 28 sloped at a control angle 30, shown as an acute angle measured relative to guide channels 20 in FIG. 5. Control angle 30 is, preferably, substantially equal to the slope of first sloped wall 22.

Figure 2:
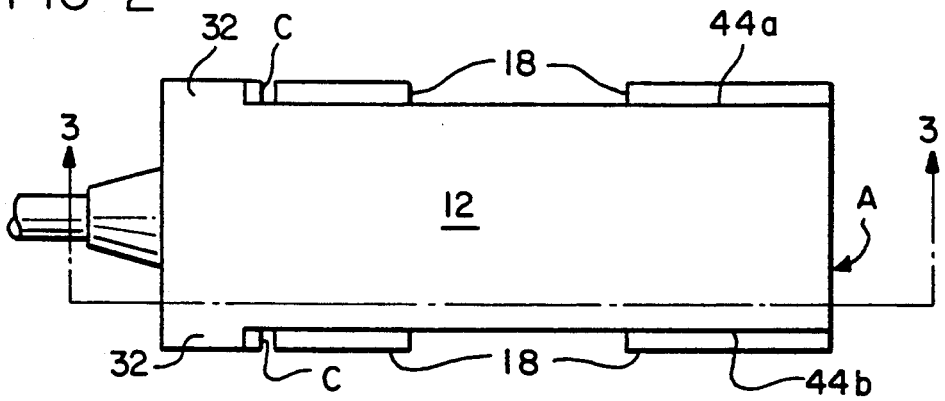
FIG. 2 is a top view of the terminal housing of the present invention.

Referring to FIGS. 1, 2 and 5, in addition, one or more trailing down ramps 32 may be provided on terminal housing 12 and at least one second sloped wall 42 may be formed in guide channels 20 to assist in maintaining the generally parallel relationship and alignment between terminal housing 12 and receptacle frame 14. Trailing down ramps 32 and at least one second sloped wall 42 preferably include surfaces sloped at an angle equal to the control angle 30, and provide a second contact point in addition to contact between the keying flanges 18 and the first sloped wall 22 to direct the keying flanges 18 into the keying slots 24. One or more of the keying flanges 18 may also include surfaces sloped at an angle equal to control angle 30, to enhance control of keying flanges 18 in keying slots 4. Where first and second sloped walls 22, 42, side walls 8, one or more surfaces of keying flanges 18, trailing down ramp 32, terminal pins 34 and terminal pin receptacles 36 are sloped at substantially the control angle 30, a plurality of surfaces in generally parallel relationship result which align and guide the mating of terminal pins 34 and terminal pin receptacles 36.

Preferably, as shown in FIGS. 1, 2 and 9, keying flanges 18 extend substantially perpendicular to the side faces 44*a*, 44*b* of terminal housing 12. In turn, as shown in FIGS. 1, 5 and 9, guide channels 20 preferably have guide channel walls 46 substantially perpendicular to inner walls 48*a*, 48*b* of receptacle frame 14. Alternatively, keying flanges 18 and corresponding guide channel walls 46 may be angled relative to side faces 44*a*, 44*b* and inner walls 48*a*, 48*b*, respectively, as shown in FIG. 9, but such is not preferred.

Figure 3:
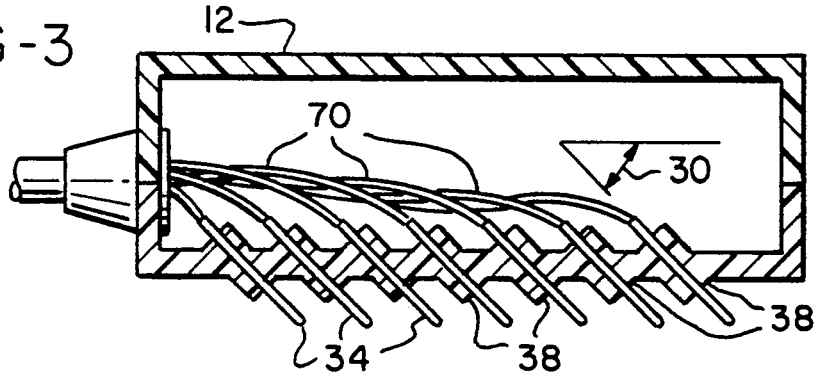
FIG. 3 is a cross-sectional view of the terminal housing of FIG. 2 taken along section line 3—3 of FIG. 2.
Figure 4:
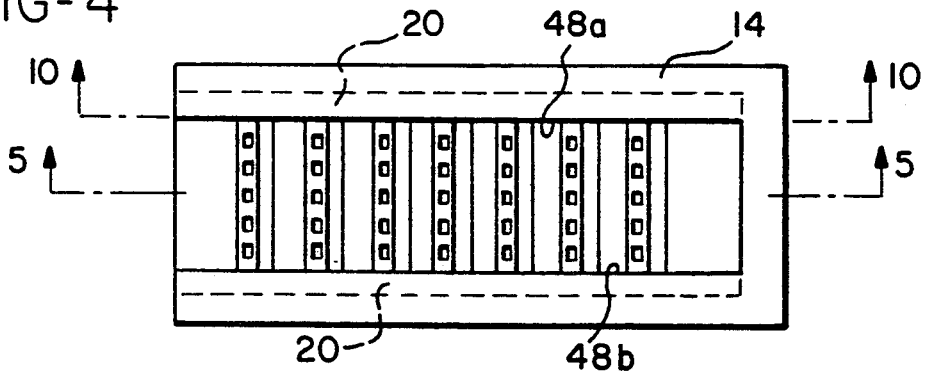
FIG. 4 is a top view of the receptacle frame of the present invention.

Terminal housing 12 and receptacle frame 14 include mating first and second electrical terminal elements, respectively, disposed at an angle relative to the direction in which a coupling force is applied. As shown best in FIGS. 3-5, first electrical terminal elements are preferably electrical terminal pins 34, and second electrical terminal elements are preferably electrical terminal pin receptacles 36. While it is preferred to provide terminal pins 34 in terminal housing 12 and terminal pin receptacles 36 in receptacle frame 14, their positions may be reversed. Preferably, terminal pins 34 and terminal pin receptacles 36 are disposed at an angle equal to control angle 30, preferably a 45 degree angle relative to guide channels 20, and are mounted so as to include mating seating surfaces 38 and 40, respectively. Terminal pins 34 and terminal pin receptacles 36 may include crimp connections or other known means to connect wiring or electrical components to terminal pins and terminal pin receptacles.

The angled positions of terminal pins 34 and terminal pin receptacles 36 are shown in FIGS. 1, 3, 5-7, 9 and 13. The angled positions permit a more compact, flatter and shorter, overall connector design, and require higher coupling and uncoupling forces than connectors which mate in a direction parallel to the applied coupling force. As such, a more secure connection results which resists accidental disconnection without need for additional fasteners.

Figure 8:
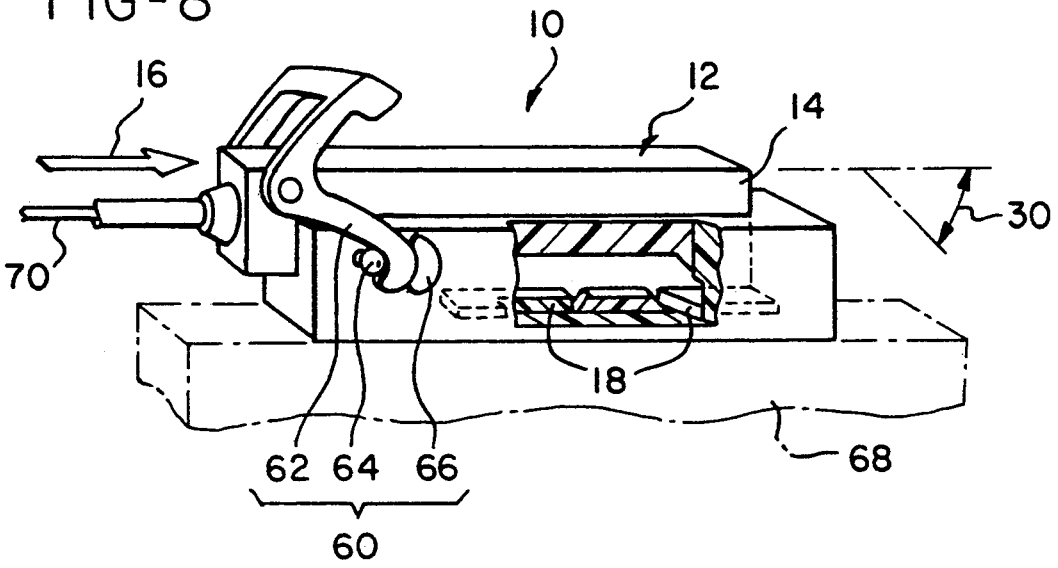
FIG. 8 is a schematic perspective view of the connector of the present invention and force applying means for inserting the terminal housing into the receptacle frame of the connector.

Shown in FIG. 8, a force applying means may be further included in the present invention to assist in coupling and uncoupling the terminal housing and receptacle frame. The force applying means is preferably a cam lever mechanism 60, such as shown, which may be used for coupling, uncoupling or both. Cam lever mechanism 60 includes a cam lever 62 operably mounted on terminal housing 12, and both a coupling cam 64 and an uncoupling cam 66 attached to receptacle frame 14 against which cam lever 62 may act to apply coupling and uncoupling forces, respectively. Where coupling and uncoupling cams 64, 66 are provided, cam lever mechanism 60 also serves to fasten terminal housing 12 to receptacle frame 14, adding an additional degree of security to the connection.

As further representatively shown in FIG. 8, terminal receptacle frame 14, or, alternatively, terminal housing 12, or both, may be attached directly to an electrical module or component 68, rather than connecting to a wiring harness or lead wires 70, 72 of a plurality of circuits, as representatively shown in FIGS. 3, and 5–7.

FIG. 8 also shows keying flanges 18 disposed in their final positions in keying slots 24 with terminal pins 34 and terminal pin receptacles 36 intermated.

Figure 6:
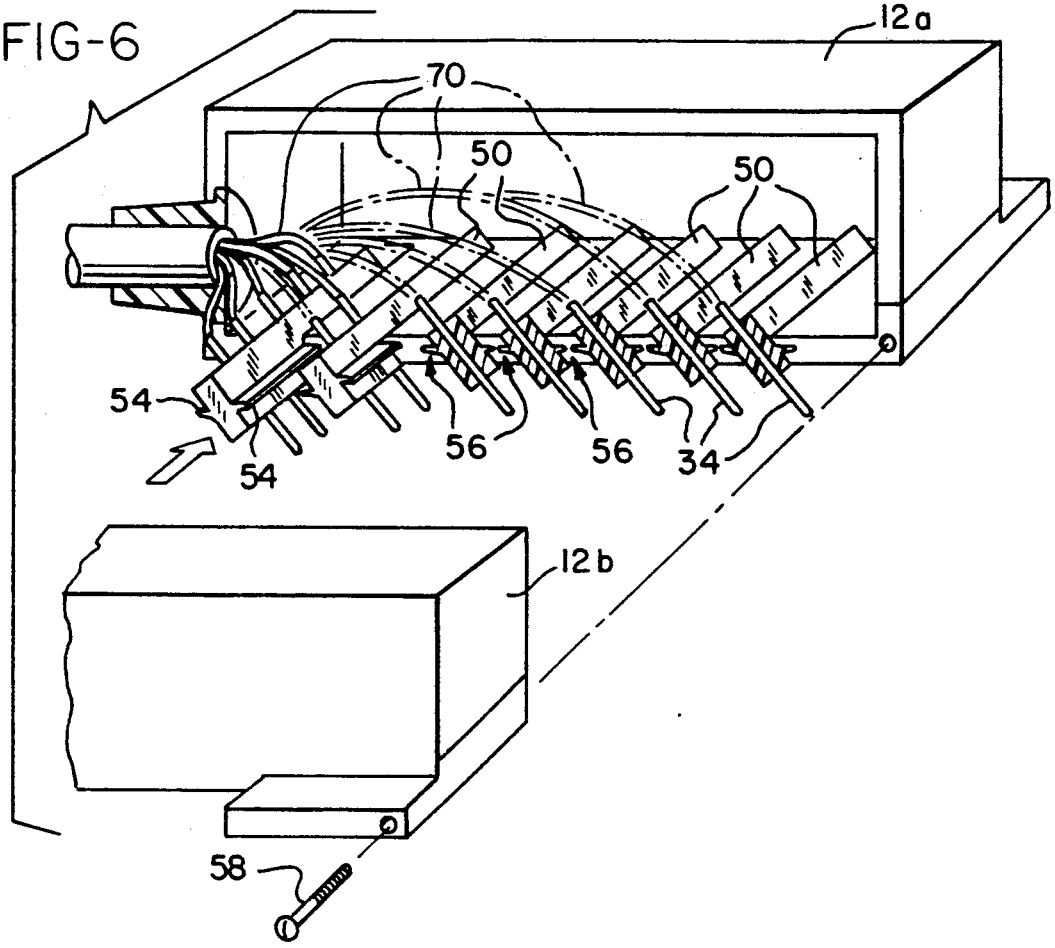
FIG. 6 is an exploded perspective view of alternative embodiment of the terminal housing of the present invention.
Figure 7:
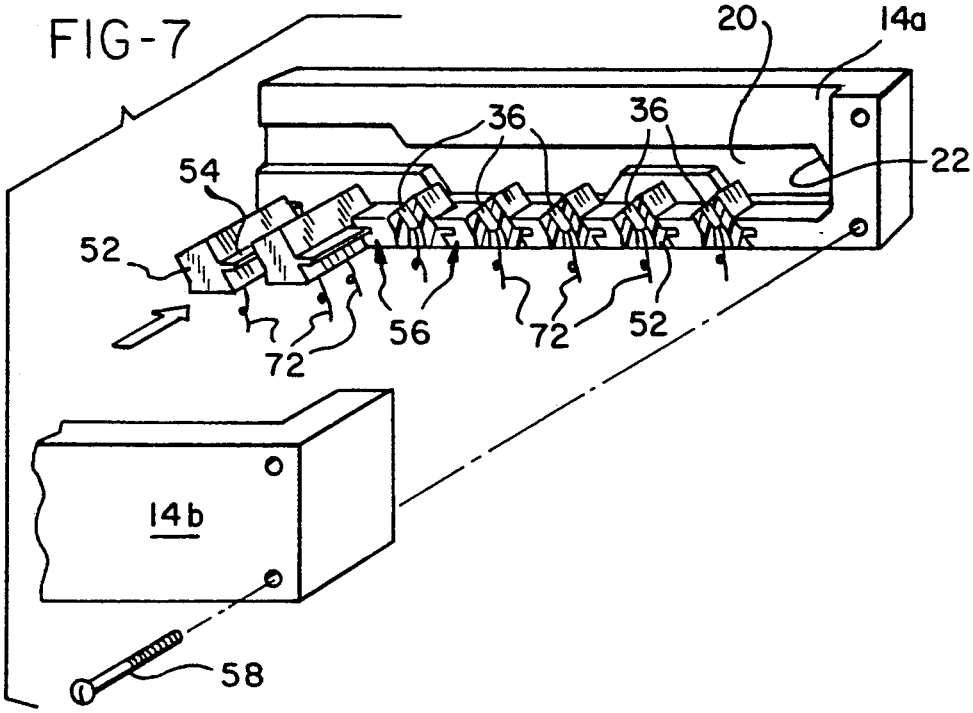
FIG. 7 is an exploded perspective view of an alternative embodiment of the receptacle frame of the present invention.

As shown in FIGS. 6 and 7, in an alternative embodiment of terminal housing 12 and receptacle frame 14, terminal pins 34 and terminal pin receptacles 36 may be assembled in groups of one or more on removable housing blocks 50 or frame blocks 52. As representatively shown, housing blocks 50 are assembled into terminal housing 12 by longitudinally dividing the terminal housing 12 into first and second portions **12*a* and 12*b*, inserting housing blocks rails 54 along tracks 56 in first portion 12*a*, sliding second portion 12*b* over the remaining portion of housing blocks 50, and securing first and second portions 12*a* and 12*b* with fasteners 58, such as screws. Assembly of frame blocks 52 is achieved in like fashion, longitudinally dividing receptacle frame into first and second portions 14*a* and 14*b*, as shown in FIG. 7**, where like numbers refer to like elements.

This alternative embodiment makes connector 10 more versatile and adaptable for various applications. As well, the alternative embodiment can facilitate certain production techniques, for example, hardwiring of the terminal pins 34 or terminal pin receptacles 36, and permits user-oriented benefits, such as interchange or replacement of one block with another for repair or testing. It is understood that terminal pins 34 and terminal pin receptacles 36 may be included in either the terminal housing 12 or receptacle frame 14, as may suit the application. It is further understood that the alternative embodiment of FIGS. 6 and 7 is representative of various assembly arrangements which are possible to provide angularly disposed electrical terminal elements on removable blocks in terminal housing 12 and receptacle frame 14.

All parts of connector 10 of the present invention are made of conventional materials, and may be attached by means known in the art. Terminal housing 12 and terminal receptacle frame 14 are preferably made of hard plastics, as are known in the art.

In a further aspect of the present invention, a system including two or more connectors 10 for connecting a plurality of electrical circuits may be provided. Each of the two or more connectors 10 have first and second electrical terminal elements disposed at an angle in accordance with the present invention. As a safety feature, the system includes means for preventing inadvertent cross-connection between unrelated terminal housings 12 and receptacle frames 14 of different connectors 10.

Referring to FIG. 9, such means for preventing cross-connection includes producing the terminal housings 12 with keying flanges 18 having different dimensions, e.g. different thicknesses, lengths or widths, and providing mating receptacle frames 14 with corresponding guide channel dimensions. As also shown in FIG. 9, another means for preventing cross-connection includes changing the angle at which keying flanges 18 extend from the side faces **44*a*, 44*b* of terminal housing 12 and changing the corresponding angle at which guide channels 20 are provided along inner walls 48*a*, 48*b* of receptacle frame 14**.

Figure 10A:
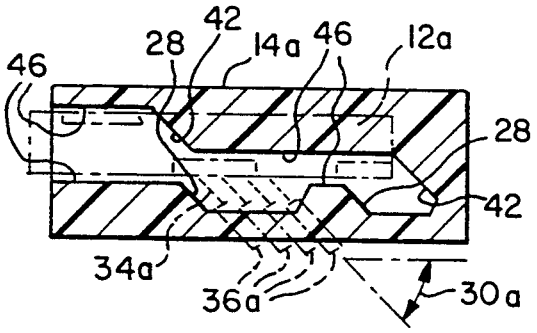
FIGS. 10A and 10B, 11A and 11B, and 12A and 12B are cross-sectional views of the receptacle frame of the present invention taken along section line 10—10 of FIG. 4 and showing means for preventing cross-connection.
Figure 10B:
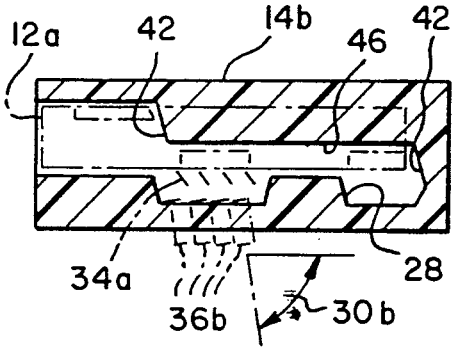
Figure 11A:
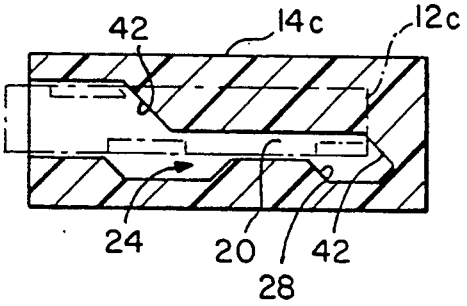
Figure 11B:
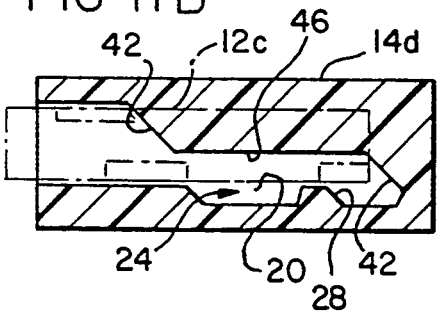
Figure 12A:
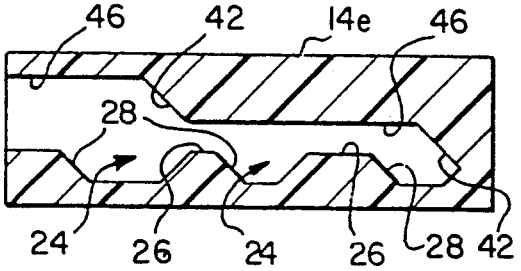
Figure 12B:
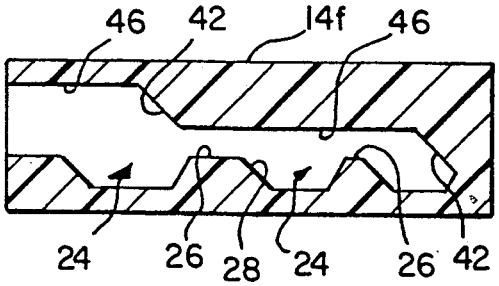

Still other means for preventing cross-connection, shown in FIGS. 10A and 10B, include providing different control angles 30 in different connectors 10 of the system. The control angles **30*a* and 30*b* in receptacle frames 14*a* and 14*b*, respectively, differ from each other and, thus, vary the angle at which other elements are correspondingly disposed. Thus, for example, the angle of the at least one first sloped wall 22, and the substantially equal angle of one or more side walls 28 of keying slots 24, and the at least one second sloped wall 42 all vary between FIG. 10A and FIG. 10B. As representatively shown, terminal housing 12*a* may thereby couple with receptacle frame 14*a*, but not receptacle frame 14*b*. Further, as shown in FIGS. 11A and 11B, the spacing between keying slots 24 and the end of guide channels 20 at sloped wall 42 may be different to prevent cross-connection. Thus, as representatively shown, terminal housing 12*c* mates with terminal receptacle 14*c*, but not with terminal receptacle 14*d*. Finally, as shown in FIGS. 12A and 12B, the spacing between keying slots 24, i.e. the size of guide key 26, may be different in different connectors 10, as representatively shown with receptacle frames 14*e* and 14*f***, to prevent cross-connection.

Figure 13:
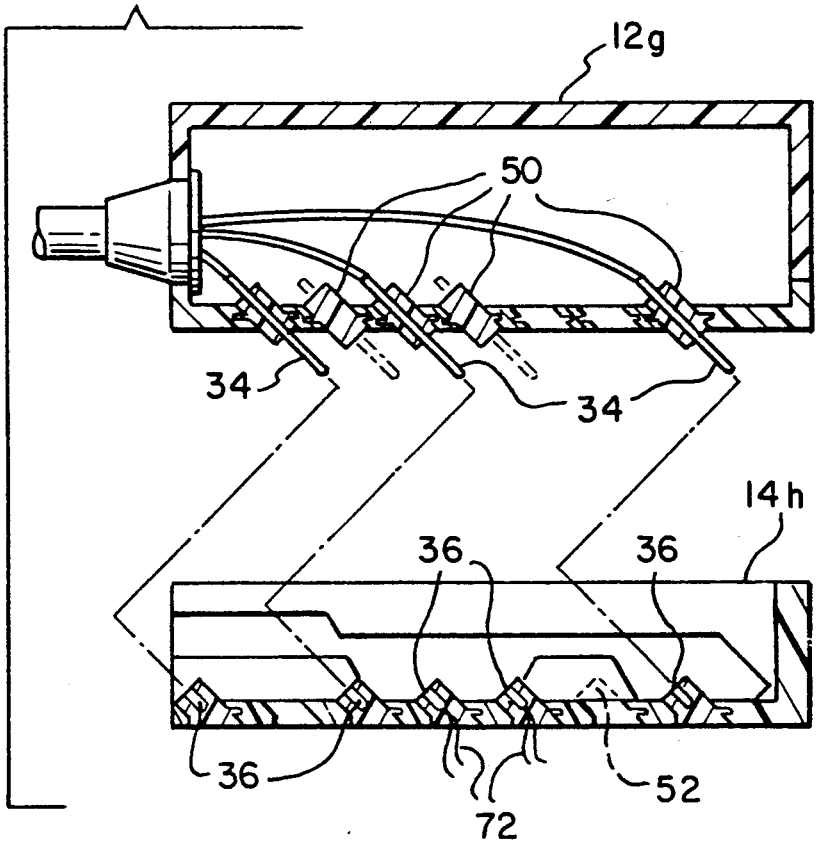
FIG. 13 is a cross-sectional view of the terminal housing of FIG. 2 taken along section line 3—3 of FIG. 2, and a cross-sectional view of the receptacle frame of the present invention taken along section line 5—5 of FIG. 4, both in an alternative embodiment, showing means for preventing cross-connection.

As well, as representatively shown in FIG. 13, because a plurality of terminal pins 34 and terminal pin receptacles 36 are provided in each connector 10, the various electrical circuits to be attached may be connected to selected terminal pins 34 and terminal pin receptacles 36 in a pattern which would prevent inadvertent cross-connection even if identical connectors 10 are used. Thus, cross-connection between wired terminal pins 34 in terminal housing **12*g* and wired receptacles in receptacle frame 14*h*** would be avoided.

Further in this regard, as shown in FIG. 13, in a system of two or more connectors 10 made in accordance with the alternative embodiment of FIGS. 6 and 7, where removable housing blocks 50 and frame blocks 52 are provided in connectors 10, means for preventing cross-connection of unrelated circuits further include selectably inserting rows of housing blocks 50 and frame blocks 52 in terminal housings 12 and receptacle frames 14. Such blocks are so located that a group of terminal pins 34 and a group of terminal pin receptacles 36 will be aligned only when mating terminal housings 12 and receptacle frames 14 are coupled. This means for preventing cross-connection may be understood by reference to FIG. 13, where housing blocks 50 and frame blocks 52, shown in phantom, have been removed so that terminal housing **12*g* and receptacle frame 14*h*** may not be cross-connected.

In a still further aspect of the present invention, a method for intereonnecting electrical circuits with a connector 10 of the present invention is provided. In accordance with the method, a connector 10 made in accordance with the present invention is assembled to connect electrical circuits or components. Terminal housing 12, having a plurality of first electrical terminal elements, is inserted into receptacle frame 14, having a plurality of second electrical terminal elements matable therewith. Terminal housing 12 is next guided within receptacle frame 14 to align the pluralities of first and second electrical terminal elements. Finally, the pluralities of first and second electrical terminal elements are intermated along a plane angularly oriented to an applied coupling or interconnecting force.

The step of guiding terminal housing 12 within receptacle frame 14 includes first sliding a plurality of keying flanges 18 extending from terminal housing 12 in a first direction along a plurality of guide channels 20 formed in receptacle frame 14, and then directing the plurality of keying flanges 18 in a second direction along keying slots 24 formed in the receptacle frame by contacting at least one first sloped wall 22 at the end of guide channels 20. The step of sliding is preferably performed in a direction substantially parallel to the applied coupling or interconnecting force, while the step of directing the plurality of keying flanges 18 along keying slots 24 directs keying flanges 18 in a second direction angled relative to the applied coupling or interconnecting force.

The step of directing keying flanges 18 along keying slots 24 may be further accomplished by contacting one or more trailing down ramps 32, which extend from side faces 44*a*, 44*b* of terminal housing 12, with at least one second sloped wall 42 formed in guide channels 20, to align and support the intermating of the first and second electrical terminal elements.

Thus, as keying flanges 18 slide in guide channels 20, a portion of leading edge A, shown in FIG. 2, contacts at least one first sloped wall 22 at a point B, representatively shown in FIG. 5. Leading edge A is preferably a square edge to provide edge or point contact for reduced friction at point B and along first sloped wall 22 as the first and second electrical terminal elements intermate. Where trailing down ramps 32 are included, a portion of leading face C thereof, also shown in FIG. 2, contacts at least one second sloped wall 42 at a point D, also representatively shown in FIG. 5. Keying flanges 18 are thereby directed down keying slots 24 in a second direction angularly related to the first direction by control angle 30, which is preferably an acute angle, as shown in FIG. 5. As terminal pins 34 and terminal pin receptacles 36 are also preferably set at control angle 30, terminal housing 12 continues down keyed slot 24, preferably until seating surfaces 38, 40 mate, intermating terminal pins 34 and terminal pin receptacles 36 and completing the connection.

The step of inserting may be accomplished with the aid of a mechanical device, such as the cam lever mechanism 60, previously discussed above. Finally, the method may further include the step of uncoupling terminal housing 12 from receptacle frame 14, which may also be accomplished with a mechanical device, such as cam lever mechanism 60.

While certain representative embodiments and details have been shown and described for purposes of illustrating the invention, it will be apparent to those skilled in the art that various changes in the article, system and method disclosed may be made without departing from the scope of the invention. For example, the position, shape or orientation of the keying flanges and trailing down ramps may be further varied, as may the shape of the connector itself. Further, the design of the force applying means may be vary, yet perform the desired function to achieve the purposes disclosed herein. Thus, these and other features of the invention may be varied, without departing from the scope of the invention which is defined in the appended claims.

What is claimed is:

1. An electrical connector comprising:

a terminal housing including a plurality of first electrical terminal elements mounted within said terminal housing;

a receptacle frame for receiving said terminal housing and including a plurality of second electrical terminal elements mounted within said receptacle frame, said plurality of second electrical terminal elements adapted to couple with said plurality of first electrical terminal elements; and guidance means for guiding said terminal housing received in said receptacle frame initially in a first direction of movement, and for guiding said plurality of first electrical terminal elements in a second direction of movement angularly oriented relative to said first direction at an acute angle to couple along said second direction of movement with said plurality of second electrical terminal elements.

2. An electrical connector as recited in claim 1 wherein said first electrical terminal elements comprise electrical terminal pins, and said second electrical terminal elements comprise electrical terminal pin receptacles for receiving said terminal pins.

3. An electrical connector as recited in claim 1 wherein said first electrical terminal elements comprise electrical terminal pin receptacles, and said second electrical terminal elements comprise electrical terminal pins.

4. An electrical connector as recited in claim 1 further comprising force applying means attached to said terminal housing and said receptacle frame for coupling said first and second electrical terminal elements, said force applying means positioned such that force is applied to said terminal housing in said first direction.

5. An electrical connector as recited in claim 4 wherein said force applying means further provides for uncoupling said first and second electrical terminal elements.

6. An electrical connector as recited in claim 4 wherein said force applying means consists of a cam lever operable mounted on said terminal housing and at least one cam attached to said receptacle frame.

7. An electrical connector comprising:

a terminal housing including a plurality of first electrical terminal elements mounted within said terminal housing;

a receptacle frame for receiving said terminal housing and including a plurality of second electrical terminal elements mounted within said receptacle frame, said plurality of second electrical terminal elements adapted to couple with said plurality of first electrical terminal elements; and guidance means for guiding said terminal housing received in said receptacle frame initially in a first direction of movement, and for guiding said plurality of first electrical terminal elements in a second direction of movement angularly oriented relative to said first direction at an acute angle to couple with said plurality of second electrical terminal elements; and wherein said plurality of first electrical terminal elements and said plurality of second electrical terminal elements are mounted at angles generally parallel to said second direction.

8. An electrical connector comprising:

a terminal housing including a plurality of first electrical terminal elements mounted within said terminal housing;

a receptacle frame for receiving said terminal housing and including a plurality of second electrical terminal elements mounted within said receptacle frame, said plurality of second electrical terminal elements adapted to couple with said plurality of first electrical terminal elements; and guidance means for guiding said terminal housing received in said receptacle frame initially in a first direction of movement, and for guiding said plurality of first electrical terminal elements in a second direction of movement angularly oriented to relative to said first direction to couple with said plurality of second electrical terminal elements, said guidance means comprising:

a plurality of keying flanges extending from said terminal housing;

a plurality of guide channels in said receptacle frame for guiding said plurality of keying flanges in said first direction;

at least one first sloped wall positioned at the end of at least one of said plurality of guide channels for directing the travel of said plurality of keying flanges; and a plurality of keying slots in said receptacle frame to permit said plurality of keying flanges to travel in said second direction generally parallel to said at least one first sloped wall.

9. An electrical connector as recited in claim 8 wherein said plurality of keying slots have side walls sloped at an angle relative to said plurality of guide channels.

10. An electrical connector as recited in claim 9 wherein the angle at which said side walls are sloped is substantially equal to the angle of said at least one sloped wall.

11. An electrical connector as recited in claim 8 wherein said plurality of guide channels have walls extending substantially perpendicularly into said receptacle frame.

12. An electrical connector as recited in claim 8 wherein said guidance means further comprises:

a plurality of trailing down ramps extending from side faces of said terminal housing; and at least one second sloped wall formed in said plurality of guide channels sloped relative to said plurality of trailing down ramps such that said plurality of trailing down ramps traveling along said at least one second sloped wall further align and support the intermating of said pluralities of first and second electrical terminal elements.

13. An electrical connector as recited in claim 8 wherein said plurality of keying flanges extend substantially perpendicularly from said terminal housing.

14. An electrical connector comprising:

a terminal housing including a plurality of first electrical terminal elements mounted within said terminal housing, wherein:

said plurality of first electrical terminal elements are disposed in a plurality of insertable housing blocks; and said terminal housing further comprises means for retaining said plurality of housing blocks;

a receptacle frame for receiving said terminal housing and including a plurality of second electrical terminal elements mounted within said receptacle frame, said plurality of second electrical terminal elements adapted to couple with said plurality of first electrical terminal elements; and guidance means for guiding said terminal housing received in said receptacle frame initially in a first direction of movement, and for guiding said plurality of first electrical terminal elements in a second direction of movement angularly oriented relative to said first direction at an acute angle to couple with said plurality of second electrical terminal elements.

15. An electrical connector comprising:

a terminal housing including a plurality of first electrical terminal elements mounted within said terminal housing, wherein:

at least one of said plurality of first electrical terminal elements are disposed in at least one insertable housing block; and said terminal housing further comprises means for retaining said at least one housing block, said means for retaining comprising at least one track in said terminal housing adapted to slidably receive at least one rail extending from ones of said housing blocks;

a receptacle frame for receiving said terminal housing and including a plurality of second electrical terminal elements mounted within said receptacle frame, said plurality of second electrical terminal elements adapted to couple with said plurality of first electrical terminal elements; and guidance means for guiding said terminal housing received in said receptacle frame initially in a first direction of movement, and for guiding said plurality of first electrical terminal elements in a second direction of movement angularly oriented relative to said first direction at an acute angle to couple with said plurality of second electrical terminal elements.

16. An electrical connector comprising:

a terminal housing including a plurality of first electrical terminal elements mounted within said terminal housing;

a receptacle frame for receiving said terminal housing and including a plurality of second electrical terminal elements mounted within said receptacle frame, said plurality of second electrical terminal elements adapted to couple with said plurality of first electrical terminal elements, wherein:

said plurality of second electrical terminal elements are disposed in a plurality of insertable frame blocks; and said receptacle frame further comprises means for retaining said plurality of frame blocks; and guidance means for guiding said terminal housing received in said receptacle frame initially in a first direction of movement, and for guiding said plurality of first electrical terminal elements in a second direction at an acute angle to couple with said plurality of second electrical terminal elements.

17. An electrical connector comprising:

a terminal housing including a plurality of first electrical terminal elements mounted within said terminal housing;

a receptacle frame for receiving said terminal housing and including a plurality of second electrical terminal elements mounted within said receptacle frame wherein:

said plurality of second electrical terminal elements are adapted to couple with said plurality of first electrical terminal elements;

at least one of said plurality of second electrical terminal elements are disposed in at least one insertable frame block; and said receptacle frame further comprises means for retaining said at least one frame block, said means for retaining comprising at least one track in said receptacle frame adapted to slidably receive at least one rail extending from ones of said frame blocks; and guidance means for guiding said terminal housing received in said receptacle frame initially in a first direction of movement, and for guiding said plurality of first electrical terminal elements in a second direction of movement angularly oriented to relative to said first direction to couple with said plurality of second electrical terminal elements.

18. A system for making electrical connections comprising:

at least two electrical connectors for making electrical connections, each of said at least two electrical connectors comprising:

a terminal housing including a plurality of first electrical terminal elements mounted within said terminal housing;

a receptacle frame for receiving said terminal housing and including a plurality of second electrical terminal elements mounted within said receptacle frame for receiving said plurality of first electrical terminal elements, said plurality of second electrical terminal elements adapted to couple with said plurality of first electrical terminal elements; and guidance means for guiding said terminal housing received in said receptacle frame initially in a first direction of movement, and for guiding said plurality of first electrical terminal elements in a second direction of movement angularly oriented relative to said first direction to couple with said plurality of second electrical terminal elements; and wherein said guidance means of said two or more electrical connectors are substantially similar, but differ in at least one dimensional relationship to prevent cross-connection of said terminal housings and receptacle frame from different ones of said at least two electrical connectors.

19. A system as recited in claim 18 wherein said second direction of movement is angularly oriented relative to said first direction at an acute angle.

20. A system as recited in claim 18 wherein said guidance means of each of said two or more electrical connectors each comprises:

a plurality of keying flanges extending from said terminal housing;

a plurality of guide channels in said receptacle frame for guiding said plurality of keying flanges in said first direction;

at least one first sloped wall positioned at the end of said plurality of guide channels for directing the travel of said plurality of keying flanges; and a plurality of keying slots in said receptacle frame to permit said plurality of keying flanges to in said second direction generally parallel to said at least one first sloped wall.

21. A system as recited in claim 20 wherein, to prevent cross-connection of said two or more electrical connectors, at least one dimension of said plurality of keying flanges and the corresponding dimensions of said plurality of guide channels and said plurality of keying slots in each of said at least two electrical connectors are different, such that selected keying flanges of one terminal housing are adapted to be received only in corresponding guide channels on one receptacle frame.

22. A system as recited in claim 20 wherein, to prevent cross-connection of said two or more electrical connectors, the spacing between said at least one first sloped wall and at least one of said plurality of keying slots and the corresponding lengths of said plurality of keying flanges in ones of said two or more electrical connectors are different, such that selected keying flanges of one terminal housing are adapted to be guided only into corresponding keying slots of one receptacle frame.

23. A system as recited in claim 20 wherein:

in each of said at least two electrical connectors, said plurality of keying slots have at least one side wall sloped at a control angle relative to said plurality of guide channels and substantially parallel to said second direction;

in each of said at least two electrical connectors, said plurality of first electrical terminal elements and said plurality of second electrical terminal elements corresponding therewith are mounted at angles generally parallel to said second direction; and to prevent cross-connection of said two or more electrical connectors, said control angle and said second direction in each of said at least two electrical connectors are different, such that selected first electrical terminal elements of one terminal housing will only couple in said second direction with corresponding second electrical terminal elements of one receptacle frame.

24. A system as recited in claim 20 wherein, to prevent cross-connection of said two or more electrical connectors, the spacing between adjacent keying flanges extending from said terminal housing and the corresponding spacing of adjacent keying slots in said receptacle frame in each of said two or more electrical connectors is different, such that selected keying flanges of one terminal housing are adapted to be guided only into corresponding keying slots of one receptacle frame.

25. A system as recited in claim 20 wherein, to prevent cross-connection of said two or more electrical connectors, the angle at which said keying flanges extend from said terminal housing and the corresponding angle at which said guide channels and said keying slots are provided in said receptacle frame in each of said two or more electrical connectors are different, such that selected keying flanges of one terminal housing are adapted to be received only in corresponding guide channels of one receptacle frame.

26. A system for making electrical connections comprising:

at least two electrical connectors for making electrical connections, each of said at least two electrical connectors comprising:

a terminal housing including a plurality of first electrical terminal elements mounted within said terminal housing;

a receptacle frame for receiving said terminal housing and including a plurality of second electrical terminal elements mounted within said receptacle frame for receiving said plurality of first electrical terminal elements, said plurality of second electrical terminal elements adapted to couple with said plurality of first electrical terminal elements; and guidance means for guiding said terminal housing received in said receptacle frame initially in a first direction of movement, and for guiding said plurality of first electrical terminal elements in a second direction of movement angularly oriented relative to said first direction at an acute angle to couple with said plurality of second electrical terminal elements; and wherein said guidance means of said two or more electrical connectors are substantially similar, and to prevent cross-connection of said two or more electrical connectors, the positions of said first electrical terminal elements and corresponding second electrical terminal elements mounted in ones of said at least two connectors are different in each of said two or more connectors, such that selected first electrical terminal elements of one terminal housing will only couple in said second direction with corresponding second electrical terminal elements of one receptacle frame.

27. A method for making electrical connections comprising the steps of:

inserting a terminal housing including a plurality of first electrical terminal elements in a first direction into a receptacle frame including a plurality of second electrical terminal elements matable therewith;

guiding said terminal housing within said receptacle frame along a path including a portion angularly oriented in a second direction relative to said first direction, such that said plurality of first electrical terminal elements align with said plurality of second electrical terminal elements as said terminal housing moves along said angularly oriented portion of said path; and applying a coupling force in a direction generally parallel to said first direction to further move said terminal housing in said second direction along said angularly oriented portion of said path and intermate said pluralities of first and second electrical terminal elements.

28. A method as defined by claim 27, wherein said step of applying a coupling force is accomplished by operating a force applying means to apply a force in said first direction which further moves said terminal housing in said second direction to intermate said pluralities of first and second electrical terminal elements.

29. A method as defined by claim 24, wherein said step of guiding is further accomplished by a plurality of trailing down ramps extending from said terminal housing and at least one second sloped wall formed in said plurality of guide channels angled relative to said plurality of trailing down ramps such that said plurality of trailing down ramps further align and support the intermating of said pluralities of first and second electrical terminal elements.

30. A method for making electrical connections comprising the steps of:

inserting a terminal housing including a plurality of first electrical terminal elements in a first direction into a receptacle frame including a plurality of second electrical terminal elements matable therewith;

guiding said terminal housing within said receptacle frame along a path including a portion angularly oriented in a second direction relative to said first direction, such that said plurality of first electrical terminal elements align with said plurality of second electrical terminal elements along said angularly oriented portion, said step of guiding comprising:

sliding a plurality of keying flanges extending from said terminal housing in said first direction along a plurality of guide channels formed in said receptacle frame; and directing said plurality of keying flanges in said second direction along a plurality of keying slots formed in said receptacle frame, by contacting at least one first sloped wall at the end of said plurality of guide channels; and applying a coupling force generally parallel to said first direction to intermate said pluralities of first and second electrical terminal elements along a path generally parallel to said second direction.

31. A method as defined by claim 30, wherein said step of directing directs said keying flanges along a plurality of keying slots having at least one side wall angled relative to said plurality of guide channels and substantially parallel to said second direction.

32. A method as defined by claim 30, wherein said step of sliding slides said keying flanges along a plurality of guide channels having walls substantially perpendicular to said receptacle frame.

33. A method as defined by claim 30, wherein said plurality of keying flanges are substantially perpendicular to said terminal housing.

34. A method as defined by claim 27 wherein said first and second terminal elements extend from said terminal housing and said receptacle frame generally parallel to said second direction, and wherein:

said step of guiding includes aligning ones of said plurality of first terminal elements end to end with ones of said plurality of second electrical terminal elements in ones of a plurality of paths generally parallel to said second direction; and said step of applying a coupling force intermates said pluralities of first and second terminal elements along said plurality of paths generally parallel to said second direction.

35. A method as defined by claim 30, wherein said force applying means comprises a cam lever operably mounted on said terminal housing and at least one cam attached to said receptacle frame.

* * * * *

UNITED STATES PATENT AND TRADEMARK OFFICE

CERTIFICATE OF CORRECTION

PATENT NO. : 5,156,558

DATED : October 20, 1992

INVENTOR(S) : T.D. Belanger, Jr.

It is certified that error appears in the above-identified patent and that said Letters Patent is hereby corrected as shown below:

Col. 10, Line 59 "direction at an acute angle" should be --direction of movement angularly oriented relative to said first direction at an acute angle-.

Col. 11, Line 66 "to in said" should be --to travel in said-.

Signed and Sealed this

Second Day of November, 1993

*Attest:*

Bruce Lehman

BRUCE LEHMAN

*Attesting Officer*

*Commissioner of Patents and Trademarks*